US008763718B2

(12) United States Patent
Jorgensen

(10) Patent No.: US 8,763,718 B2
(45) Date of Patent: Jul. 1, 2014

(54) REMOTE VARIABLE ADJUSTMENT OF RIPPER SHANK DEPTH

(75) Inventor: John E. Jorgensen, Andover, MN (US)

(73) Assignee: Caterpillar Inc., Peoria, IL (US)

( * ) Notice: Subject to any disclaimer, the term of this patent is extended or adjusted under 35 U.S.C. 154(b) by 192 days.

(21) Appl. No.: 13/271,145

(22) Filed: Oct. 11, 2011

(65) Prior Publication Data

US 2013/0087354 A1 Apr. 11, 2013

(51) Int. Cl.
*A01B 63/00* (2006.01)

(52) U.S. Cl.
USPC ..... 172/663; 172/464; 172/668; 172/699

(58) Field of Classification Search
USPC ..... 172/464, 484, 663, 666.699, 700, 713, 172/666, 668, 699
See application file for complete search history.

(56) References Cited

U.S. PATENT DOCUMENTS

| | | | | |
|---|---|---|---|---|
| 3,032,903 | A * | 5/1962 | Ede | 37/370 |
| 3,120,281 | A * | 2/1964 | Peveler et al. | 172/699 |
| 3,461,971 | A * | 8/1969 | Sprenkel | 172/710 |
| 3,857,609 | A * | 12/1974 | Felix | 299/37.4 |
| 4,219,947 | A * | 9/1980 | Paladino | 37/370 |
| 4,327,509 | A * | 5/1982 | Bean | 37/404 |
| 4,991,659 | A | 2/1991 | Stepe et al. | |
| 5,090,141 | A | 2/1992 | Hall | |
| 5,797,460 | A | 8/1998 | Parker et al. | |
| 6,012,535 | A | 1/2000 | Theobald et al. | |
| 2003/0066664 | A1 | 4/2003 | Matthews | |

FOREIGN PATENT DOCUMENTS

| | | |
|---|---|---|
| JP | H7102589 | 4/1995 |
| KR | 200450765 | 10/2010 |

* cited by examiner

*Primary Examiner* — Alicia Torres

(57) ABSTRACT

A ripper assembly includes a ripper frame, which has at least one slot disposed in each of two opposing sidewalls. The ripper frame accommodates a ripper shank in a channel within the ripper frame. A pin is provided to pass through the at least one slot and through a through-way in the ripper shank to constrain the ripper shank within the ripper frame. At least one pressure source supplies pressure to the ripper shank to engage the ripper shank in a position.

19 Claims, 8 Drawing Sheets

REMOTE VARIABLE ADJUSTMENT OF RIPPER SHANK DEPTH

TECHNICAL FIELD

This invention relates to earth working equipment, and more particularly to a ripper with an adjustable ripper shank that provides for remote depth adjustment.

BACKGROUND

Various forms of earth moving equipment include apparatus for tilling or "ripping" the terrain, thus enabling a variety of benefits. While initially developed for agriculture, ripping is often used today as an alternative to drilling and blasting with explosives.

Modern tractors of the 1950s and 1960s advanced ripping capabilities by mounting the ripper to the rear of the machine. This design, coupled with advanced hydraulic systems, more machine weight, and greater horsepower, greatly improved ripping performance and efficiency. These advances in performance were welcomed as environmental factors began to limit or restrict conventional blasting techniques. Urban encroachment, safety, and pollution concerns all have placed much greater demands on customers' ability to use drill and blasting as a way to remove material. In the mining world, concern for mixing materials, process improvements (leach pads), and similar safety and environmental considerations likewise increased interest in ripping. As the interest in ripping has grown, so has the need for ripping equipment that meets the needs of a user.

One example of recent developments in ripping equipment is provided in U.S. Pat. No. 6,012,535, entitled "Mounting arrangement for a ripper shank." This patent discloses a ripper shank that is mounted in a channel defined in a ripper frame. A pair of piston members is mounted in the frame on opposite sides of the ripper shank. The piston members are urged into engagement with the ripper shank by a biasing mechanism that is positioned between the frame and the piston members. While an equipment operator is provided with an ability to perform remote adjustments, adjusting the ripper requires resting the ripper on the ground and adjusting the frame relative to the ripper. Thus, this assembly is generally complicated and uses a considerable number of parts.

Thus, there is a need for an improved ripping apparatus.

SUMMARY

A ripper assembly includes a ripper frame, which has at least one slot disposed in each of two opposing sidewalls. The ripper frame accommodates a ripper shank in a channel within the ripper frame. A pin is provided to pass through the at least one slot and through a through-way in the ripper shank to constrain the ripper shank within the ripper frame. At least one pressure source supplies pressure to the ripper shank to engage the ripper shank in a position.

Another embodiment of the ripper assembly includes a ripper frame, with a ripper shank disposed in a channel within the ripper frame. A pin is disposed through at least one slot in a side of the ripper frame and a through-way within the ripper shank. At least one pressure source is mounted to the ripper frame to apply pressure to at least one surface of the ripper shank to lock the ripper shank into a position within the ripper frame.

A method of fabricating a ripper assembly is provided. The method includes selecting a ripper frame and incorporating at least one slot in the ripper frame. A ripper shank is loaded into a channel of the ripper frame. A pin is disposed through the at least one slot and a through-way disposed in the ripper shank. The pin is secured to the ripper frame.

DETAILED DESCRIPTION

Figure 1:
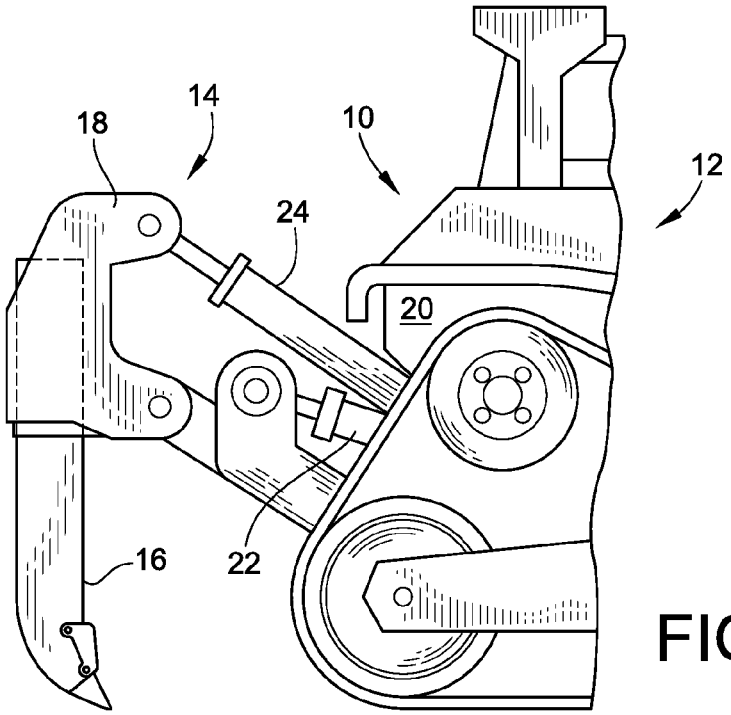
FIG. 1 is a diagrammatic side elevation view of a portion of a machine having a ripper assembly mounted thereon that embodies the principles of the present invention.

Referring now to FIG. 1, it can be seen that a rear portion 10 of a track type machine 12 (such as a bulldozer, partially shown) has a ripper assembly 14 mounted on the rear portion 10 thereof. The ripper assembly 14 has a ripper shank 16 that is mounted within a ripper frame 18. The ripper frame 18 is pivotally mounted to the rear frame 20 of the machine 12 and is raised and lowered by one or more lower hydraulic cylinders 22 that are mounted between the ripper frame 18 and the machine frame 20. The attitude of the ripper shank 16 is controlled by one or more upper hydraulic cylinders 24 that extend between the ripper frame 18 and the machine frame 20. The ripper frame 18 and the ripper shank 16 may be lowered to a point wherein at least a portion of the ripper shank 16 is embedded in the ground to penetrate and break up the terrain as the machine 12 is driven forward.

Figure 2:
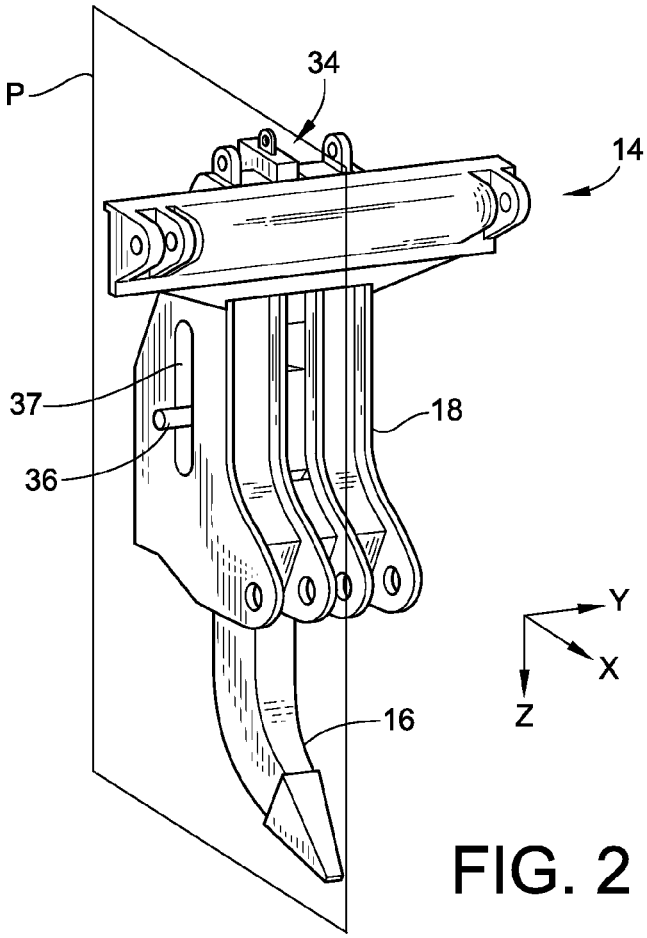
FIG. 2 is an isometric view of the ripper assembly, separated from the machine, and defining a section plane, P, for referencing.

Refer now to FIG. 2 where the ripper assembly 14 is shown from a perspective view. As shown in this view, the ripper assembly 14 may be considered as being bisected by an imaginary section plane, P. The imaginary section plane, P, is provided for relating the additional drawings and the discussion herein with the ripper assembly 14 and the components thereof.

Also shown in FIG. 2 is a slot 37 disposed along one side of the ripper frame 18. Installed in the slot 37 is a pin 36. As discussed in greater detail herein, the pin 36 is disposed through the ripper shank 16 and secured to the ripper frame 18, thus constraining the ripper shank 16 within the ripper frame 18. In some embodiments, the slot 37 is included in an interior portion of the ripper frame 18, and therefore not exposed to the surroundings as shown in FIG. 2. Therefore, the slot 37 and the pin 36 are protected from dirt and debris that results from the ripping of the terrain.

Figure 3:
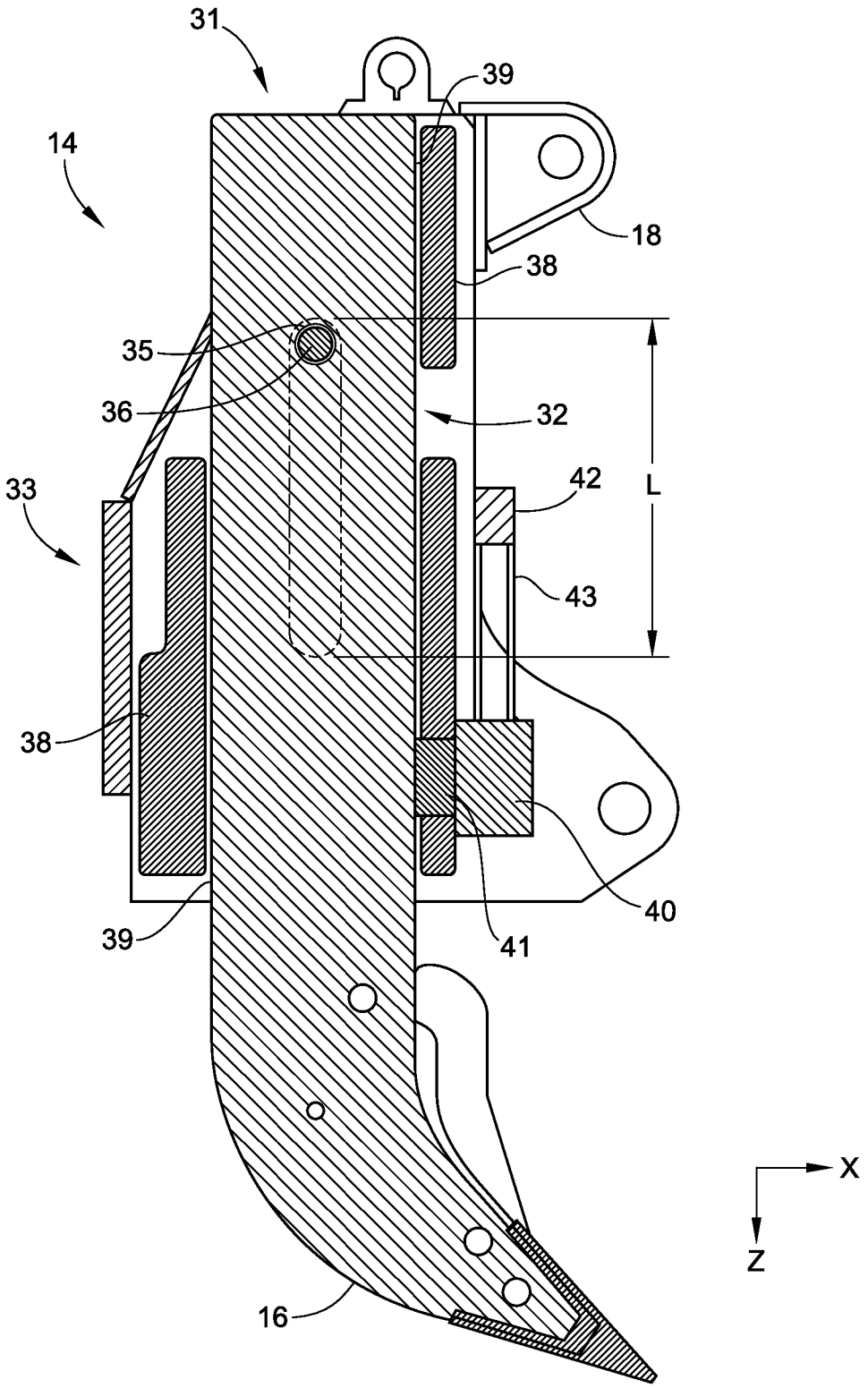
FIGS. 3 through 5 are diagrammatic side views of the ripper assembly of FIG. 2, where the view provides cutaway illustrations of the assembly at the section plane, P.
Figure 4:
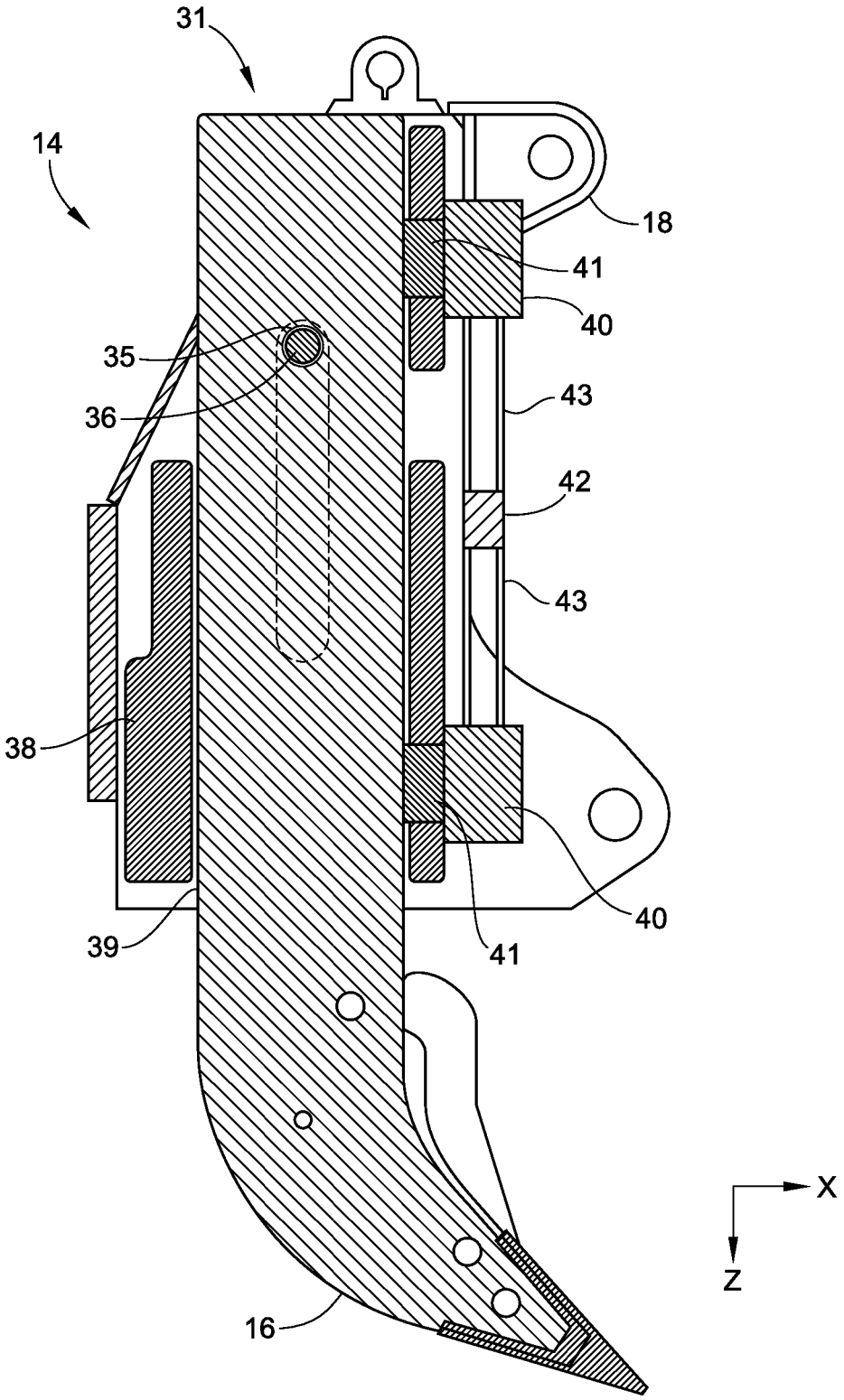
Figure 5:
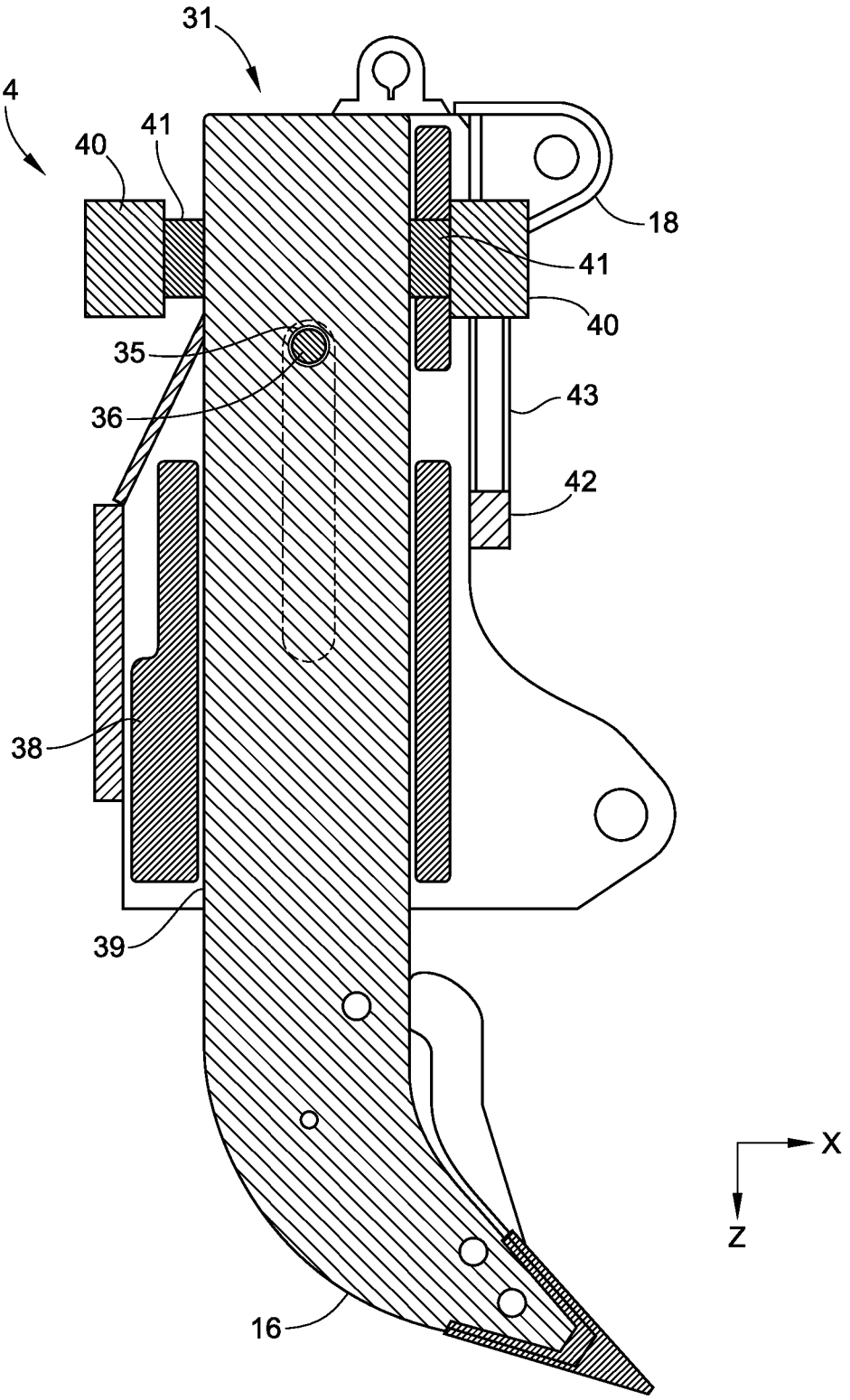

Refer now also to FIGS. 3-5, in which cutaway views of the ripper assembly 14 are provided along the imaginary section plane, P. In this embodiment, the ripper shank 16 is shown disposed in a channel 31 within the ripper frame 18. The channel 31 is defined within the ripper frame 18, and includes a forward wall 32 and a rearward wall 33 or "aft" wall. The forward wall 32 and rearward wall 33 are connected by two orthogonally oriented sidewalls 34, one of which is shown in FIG. 2. The channel 31 includes a plurality of contact surfaces 39 which are surfaces of channel 31 that make contact with the ripper shank 16. The contact surfaces 39 may be those defined by the ripper frame 18, or by elements associated with the ripper frame 18, such as at least one insert 38. The ripper shank 16 travels along the Z-axis, within the channel 31 when positioning of the ripper shank 16 is adjusted.

A combination of the pin 36 and the slots 37 ensure retention and provide limits of movement of the ripper shank 16. Once the ripper shank 16 has been placed into the channel 31, the pin 36 may be inserted through one side of the ripper frame 18, through a first slot 37 in a sidewall of the ripper frame 18, through a through-way 35 disposed in the ripper shank 36, and then secured on an opposite side of the ripper frame 18 in another slot 37.

The pin 36 may be fashioned as a bolt that screws into the ripper shank 16, as a generally straight rod that is snugly or loosely fit into the ripper shank 16, or in any other manner deemed appropriate. For example, the pin 36 may screw through the through-way of the ripper shank 16, or may fit within in a slightly over-sized through-way 35, such that insertion of the pin 36 is simplified. The pin 36 may include a bolt that receives a nut on the opposite end of the pin 36 (i.e., the opposite side of the ripper frame 18), or on each end of the pin 36. Other embodiments of the pin 36 may be used.

In general, the slots 37 are elongated through-ways through a central portion of opposing sides of the ripper frame 18, and are of a length, L (although the slots 37 are disposed in the ripper frame 18, and therefore not in the plane, P, (which is the plane shown in FIGS. 3-5) the length, L, of the slots 37 is super-imposed for reference and a better understanding of the teachings herein). In general, the slots 47 are disposed along the Z-axis of the ripper frame 18, and through opposing sides of the ripper frame 18.

When the ripper shank 16 is installed within the ripper frame 18, the pin 36 is disposed through each of the slots 37. The combination of the pin 36 mounted in the ripper frame 18 and the ripper shank 16 constrain the ripper shank 16 as the ripper shank 16 is adjusted upward and downward (i.e., along the Z-axis). Insertion of the pin 36 may be facilitated by incorporation of an oversized through-way 35 in the ripper shank 16.

In the embodiments shown in FIGS. 3-5, various hydraulic components are included to lock a position of the ripper shank 16. Exemplary components include a lock valve 42, a hydraulic line 43, a hydraulic cylinder 40, and a pressure plate 41 as are known in the art. A plurality of the foregoing components may be included.

In the embodiments depicted in FIGS. 3-5, the hydraulic cylinder 40 is mounted to the ripper frame 18 and orthogonally oriented to a side of the ripper shank 16 (shown as the forward side in FIG. 3). The pressure plate 41 which is mounted to the hydraulic cylinder 40 frictionally engages the ripper shank 16 when pressure is applied thereto by the hydraulic cylinder 40. Thus, the ripper shank 16 is secured in place along the Z-axis when engaged.

The hydraulic cylinder 40 receives hydraulic fluid through at least one hydraulic line 43, which is in turn fed hydraulic fluid through at least one lock valve 42. The lock valve 42 receives hydraulic fluid through other hydraulic components as are known in the art.

Thus, a remote operator (e.g., the equipment operator) may facilitate the hydraulic components to cause the ripper shank 16 to freely travel up and down (i.e., along the Z-axis). The ripper shank 16, however, will not disengage from the ripper frame 18 as the ripper shank 16 is constrained by the pin 36 installed through the slots 37 and through-way 35. Once set into a desired position, such as by moving the ripper frame 18 while the ripper shank 16 rests on the terrain, the operator can set the position of the ripper shank 16, for example, by commanding pressure to the hydraulic cylinder 40, and a depth of the ripper shank 16 will be locked or secured.

Referring to FIG. 3, a first embodiment includes a single hydraulic cylinder 40 and pressure plate 41. In FIG. 4, a second embodiment includes dual hydraulic cylinders 40 with accompanying pressure plates 41. Common to both embodiments, the pressure is applied in one direction. In a third embodiment, as shown in FIG. 5, dual hydraulic cylinders 40 with accompanying pressure plates 41 are used, and pressure is applied in opposing directions (with each of the hydraulic cylinders 40 applying force toward the opposing hydraulic cylinder 40).

Figure 6:
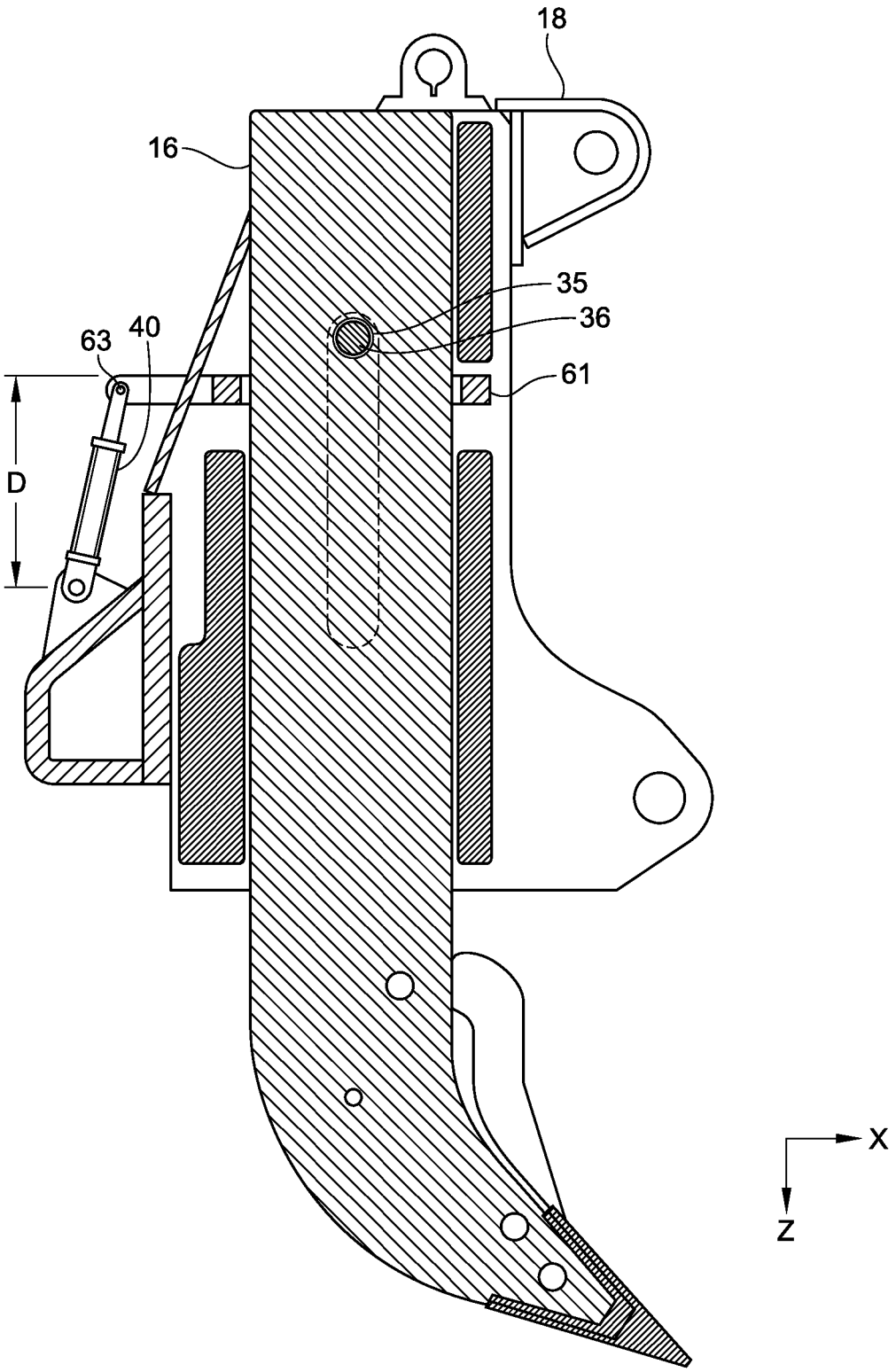
FIG. 6 is diagrammatic side view of another embodiment of the ripper assembly of FIG. 2.

Referring now to FIG. 6, an additional embodiment for locking a position of the ripper shank 16 is shown. In this example, the hydraulic cylinder 40 is pivotally mounted to an aft side of the ripper frame 18 (however, the hydraulic cylinder 40 may be mounted in any position or placement deemed appropriate). A collar 61 is disposed some distance, D, above or below the pivotal mounting of the hydraulic cylinder 40. At least one hydraulic cylinder 40 and collar 61 combination may be used.

Figure 7:
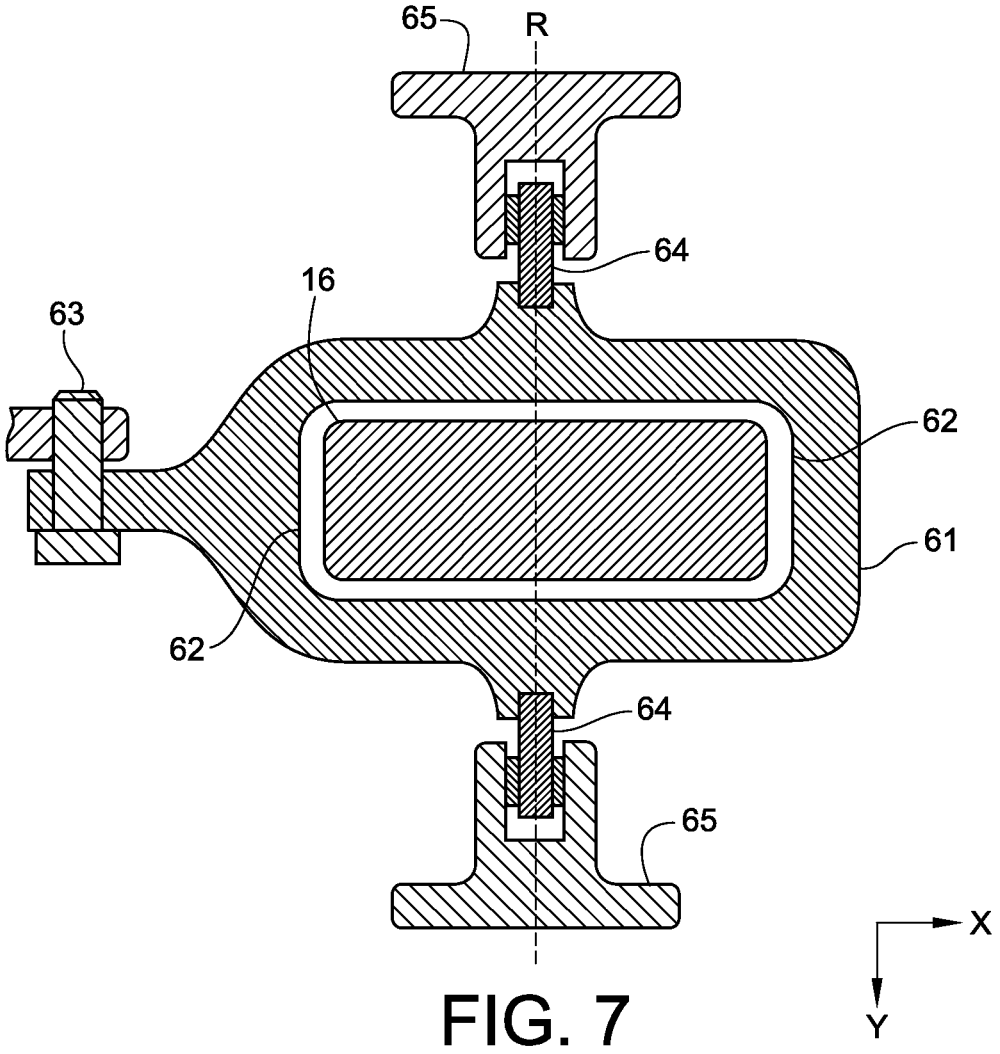
FIG. 7 is a diagrammatic top view of the ripper assembly depicted in FIG. 6.

The collar 61 is pivotally coupled to a distal end of the hydraulic cylinder 40 by use of a coupling 63. Referring now also to FIG. 7, the collar 61 may completely surround the ripper shank 16 or the collar 61 may partially surround the ripper shank 16. In the embodiment depicted, the collar 61 is rotatably mounted in at least one trunnion 65, each of which is in turn mounted to the ripper frame 18. More specifically, in this example, the collar 61 includes at least one collar pin 64. Each collar pin 64 rests in the respective trunnion 65, where each of the trunnion 65 provides a cradle for the respective collar pin 64, therefore enabling rotation of the respective collar pin 64. Thus, the collar 61 may exhibit a limited rotation about an axis of rotation, R.

Figure 9:
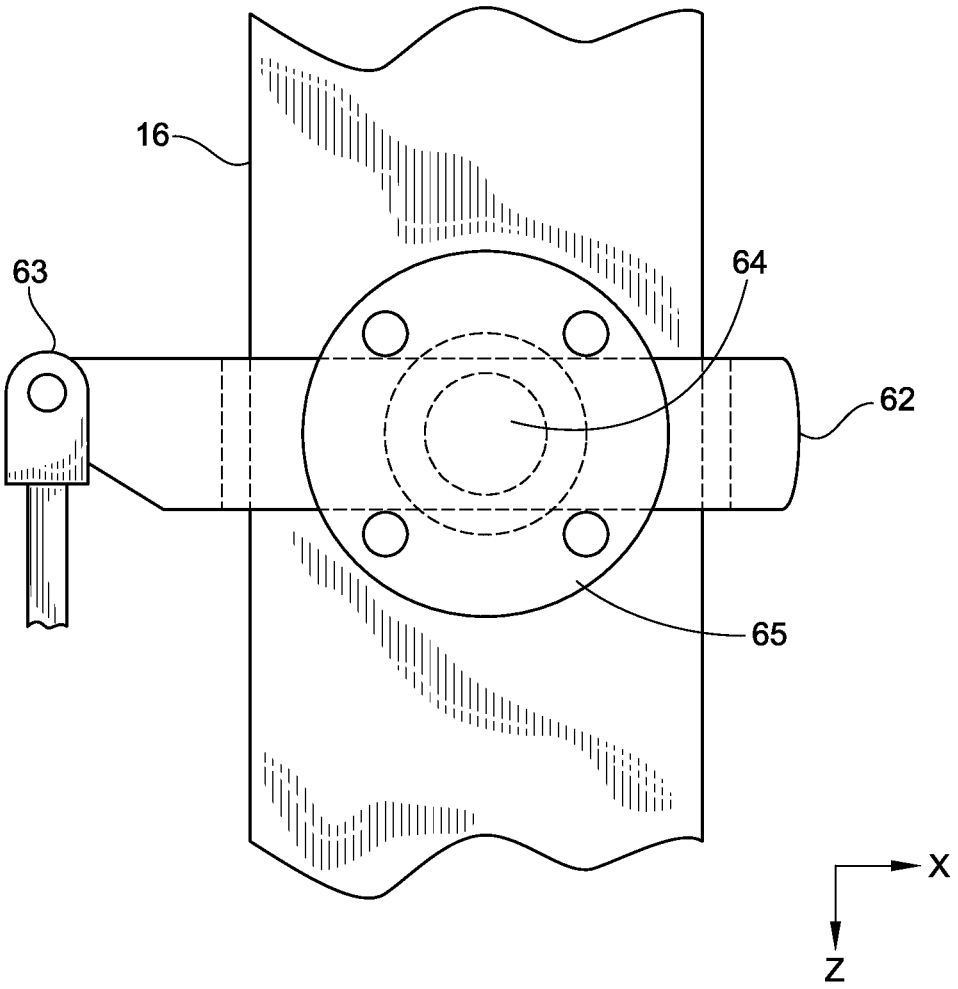
FIG. 9 is another diagrammatic side view of the ripper assembly of FIGS. 6, 7 and 8.

The at least one trunnion 65, collar 61 and collar pin 64 may be disposed within the channel 31, above or below the channel 31. As shown in FIG. 9, the trunnion 65 may be bolted to the ripper frame 18.

Figure 8:
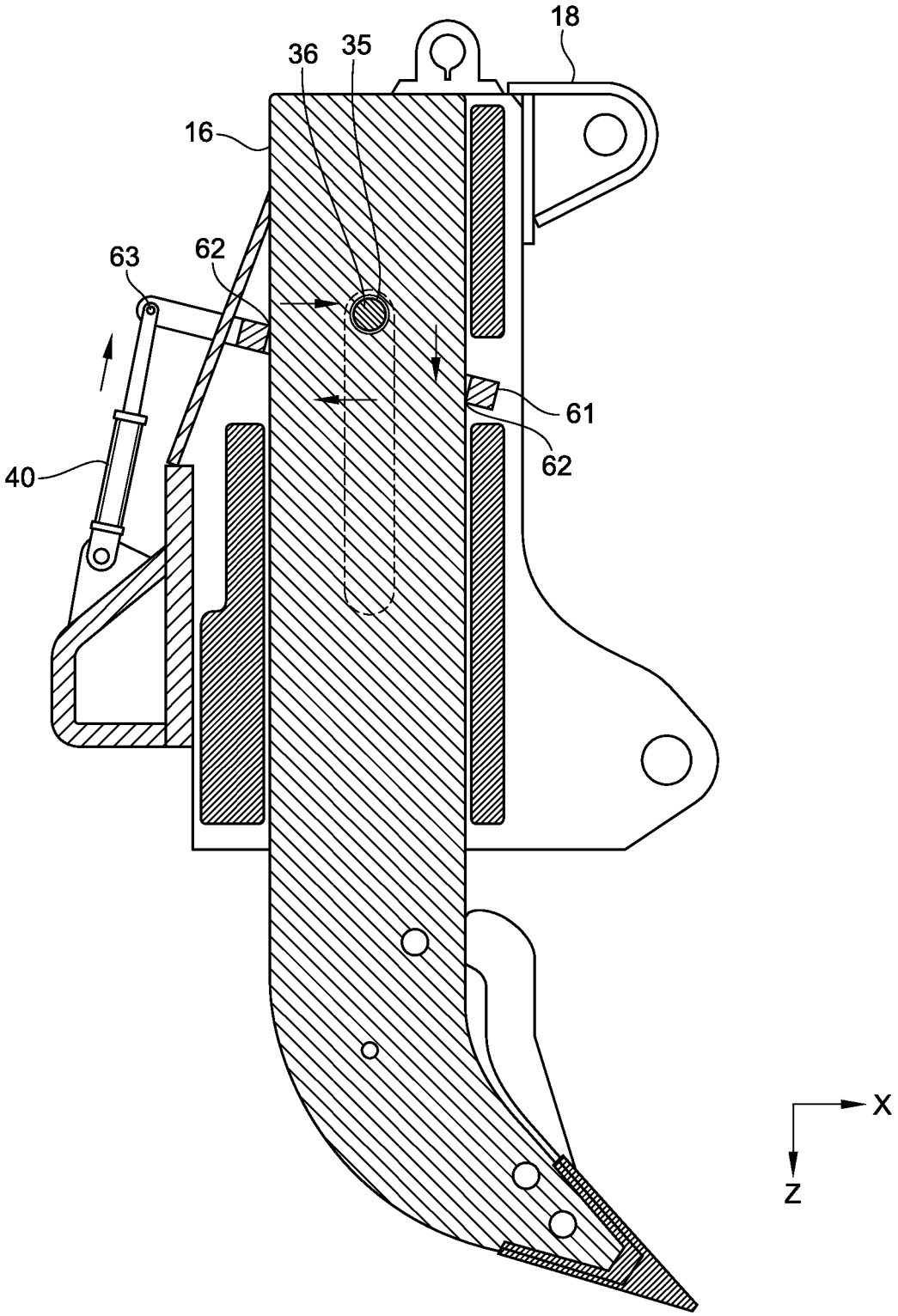
FIG. 8 is diagrammatic side view of the embodiment of the ripper assembly of FIG. 6, shown in an actuated position.

As shown in FIG. 8, extension of the hydraulic cylinder 40 causes at least one clamping surface 62 of the collar 61 to engage the ripper shank 16. Thus, as extension of the hydraulic cylinder 40 is increased, clamping force of the collar 61 is increased. Efficacy of the clamping force of the collar 61 may be increased with adaptations to the collar 61, such that an area of the clamping surface 62 is increased. For example, when surfaces of the collar 61 that engage the ripper shank 16 may be angled such that, when in an engaged position, a full width of the collar 16 makes contact with the ripper shank 16.

In order to reposition the ripper shank 16, an operator may relieve pressure in the hydraulic cylinder 40, which in turn causes relief of the clamping force imposed by the collar 61. The ripper shank 16 may then be repositioned within the ripper frame 18 such as by lowering or raising the ripper frame 18, while a tip of the ripper shank 16 rests on the surrounding terrain.

The teachings herein may be used to provide retrofit of an existing ripper assembly 14. That is, for example, the prior art ripper frame and ripper shank may be adapted with the slots and pins disclosed herein. The ripper frame may be provided with appropriate hydraulic components, electrical components and the like, such that an existing ripper assembly may be complimented with equipment to lock a position of the ripper shank. Further, existing machinery, such as a prior art bulldozer, may be provided with controls such that a user, such as an equipment operator, may adjust the ripper assembly from a remote console. Techniques as may be required for performing the retrofit are generally known in the art.

As a matter of convention, it should be recognized that the term "locking" as used herein generally refers to frictional engagement of the ripper shank 16 to a surface, such that a position of the ripper shank 16 is substantially maintained or secured within the ripper frame 18.

Further, it should be recognized that use of hydraulics is merely illustrative of one technique for applying pressure to the ripper shank 16. For example, a motorized screw could be used as well or in place of the hydraulics. Accordingly, a "source of pressure" or "pressure source" is provided herein to provide for locking of the ripper shank 16.

Generally, a "control system" (not shown) is used for enabling remote control of the source of pressure. That is, the control system, which may include components such as a display, a switch, an actuator, a sensor, a motor and the like, provides for engagement and disengagement of the source of pressure by an operator such as an operator of the machine 12. Accordingly, the control system is in communication with and control of the source of pressure while providing an interface to the user (i.e., an operator).

INDUSTRIAL APPLICABILITY

Thus, equipment operators are provided with an apparatus for ripping terrain, where the apparatus may be adjusted remotely. Equipment manufacturers and owners are provided with a simple design for remotely variably adjusting a ripper shank depth that is economic to maintain and manufacture.

When equipped with the ripper assembly disclosed herein, the operator of the machine is able to make rapid and remote adjustment to a depth of the ripper shank. For example, when an operator wishes to extend the ripper so as to expose more of the ripper shank to provide for deeper ripping of the terrain, the operator may remotely lift the ripper frame. Once the ripper frame has been lifted, lateral pressure (i.e., the pressure source) on the ripper shank is at least partially disengaged. Given the weight of the ripper shank, the ripper shank will then extend downward relative to the ripper frame. When a desired extension has been realized, the operator will then remotely apply the pressure to the ripper shank, essentially locking the ripper shank in place relative to the ripper frame. The operator may then remotely lower the ripper frame and commence ripping to greater depths.

Likewise, insertion of the ripper shank into the ripper frame may be accomplished by remotely relieving pressure on the ripper shank, lowering the ripper frame, and remotely reapplying the pressure to the ripper shank, essentially locking the ripper shank in place relative to the ripper frame. The ripper frame may then be lifted remotely, thus providing the operator with a shortened ripping tool.

The combination of the pin and the slot provide for secure retention of the ripper shank. That is, the operator cannot inadvertently overextend or drop the ripper shank from the frame, as the ripper shank will be supported by the pin which traverses the slot. Accordingly, it should be recognized that the pin is generally strong enough to support a weight (and some acceleration) of the ripper shank.

Having disclosed aspects of embodiments of the invention, it should be recognized that a variety of additional embodiments of apparatus and methods may be realized. Accordingly, while the invention has been described with reference to exemplary embodiments, it will be understood by those skilled in the art that various changes may be made and equivalents may be substituted for elements thereof without departing from the scope of the invention. For example, steps of fabrication may be adjusted, as well as techniques for applying lateral pressure, components used and the like. In some embodiments, the ripper frame may include only one slot. Many modifications will be appreciated by those skilled in the art to adapt a particular arrangement or material to the teachings of the invention without departing from the essential scope thereof. Therefore, it is intended that the invention not be limited to the particular embodiments disclosed as the best mode contemplated for carrying out this invention.

What is claimed is:

1. A ripper assembly, comprising:

a ripper frame comprising at least one vertical elongated slot extending along a length of the ripper frame and disposed in each of two opposing sidewalls;

a ripper shank disposed in a channel of the ripper frame; a pin configured to pass through the at least one slot and a through-way of the ripper shank to constrain the ripper shank within the ripper frame; and at least one pressure source to supply pressure to the ripper shank to engage the ripper shank into a position within the ripper frame.

2. The assembly of claim 1, wherein the pin comprises one of a bolt adapted for screwing into the ripper shank and a bolt to fit within the ripper shank.

3. The assembly of claim 1, wherein the at least one pressure source comprises at least one of a hydraulic cylinder.

4. The assembly of claim 1, wherein the at least one pressure source further comprises a pressure plate for communicating the pressure to the ripper shank.

5. The assembly of claim 1, wherein the at least one pressure source comprises a first hydraulic cylinder and a second hydraulic cylinder, the first hydraulic cylinder and the second hydraulic cylinder each having a corresponding pressure plate.

6. The assembly of claim 5, wherein the first and second hydraulic cylinders are adapted to provide pressure to the ripper shank in a first direction.

7. The assembly of claim 5, wherein the first cylinder is adapted to provide pressure to a first side of the ripper shank and the second hydraulic cylinder is adapted to provide pressure to a second side of the ripper shank.

8. The assembly of claim 1, further comprising a control system to enable a remote control of the at least one pressure source.

9. The assembly of claim 1, further comprising a console to enable control of the at least one pressure source from the console.

10. A ripper assembly, comprising:

a ripper frame;

a ripper shank disposed within a channel of the ripper frame; a pin disposed through at least one vertical elongated slot extending along a length of the ripper frame in a side of the ripper frame and a through-way within the ripper shank; and at least one pressure source mounted to the ripper frame and adapted to apply pressure to the ripper shank to lock the ripper shank into a position within the ripper frame.

11. The ripper assembly of claim 10, further comprising a collar that at least partially surrounds the ripper shank.

12. The ripper assembly of claim 11, wherein the collar is mounted in at least one trunnion that is coupled to the ripper frame.

13. The ripper assembly of claim 11, wherein the at least one pressure source comprises a hydraulic cylinder that is pivotally mounted to the ripper frame and coupled to the collar.

14. The ripper assembly of claim 13, wherein the hydraulic cylinder is extended to cause the collar to at least partially rotate and engage the ripper shank.

15. The system of claim 10, further comprising a control system to enable a remote control of the at least one pressure source.

16. The system of claim 10, further comprising a console for operation of the machinery, to enable remote adjustment of the ripper assembly from the console.

17. A method of fabricating a ripper assembly, the method comprising: selecting a ripper frame; incorporating at least one vertical elongated slot extending along a length of the ripper frame in the ripper frame;

loading into a channel of the ripper frame a ripper shank comprising a through-way disposed therein;

inserting a pin into the at least one slot and through the through-way; and securing the pin to the ripper frame.

18. The method as in claim 17, further comprising installing onto the ripper frame equipment to lock a position of the ripper shank.

19. The method as in claim 18, wherein the equipment comprises at least one of a pressure plate and a rotatable collar.

* * * * *